US005567263A

United States Patent [19]

Giasi

[11] Patent Number: 5,567,263

[45] Date of Patent: Oct. 22, 1996

[54] METHOD OF MANUFACTURING A PALLET OF CARDBOARD

[76] Inventor: Joseph P. Giasi, 20 West Park Ave., Long Beach, N.Y. 11561

[21] Appl. No.: 533,138

[22] Filed: Aug. 25, 1995

[51] Int. Cl.[6] ..... B65D 19/34; B32B 1/00

[52] U.S. Cl. ..... 156/252; 156/298; 156/310; 108/51.3

[58] Field of Search ..... 108/51.3; 156/257, 156/263, 252, 293, 297, 298, 300, 310, 314

[56] References Cited

U.S. PATENT DOCUMENTS 3,407,758 10/1968 Simkins ..... 108/51.3
4,244,766 1/1981 Yellen ..... 108/51.3
4,450,030 5/1984 Melody et al. ..... 156/310

*Primary Examiner*—Jeff H. Aftergut
*Assistant Examiner*—Michael A. Tolin
*Attorney, Agent, or Firm*—Myron Amer, PC

[57] ABSTRACT

A method of separately manufacturing a pallet platform and plural legs, both of cardboard construction material, at a manufacturing site contemplating assembly at a user's site, so that shipment therebetween is significantly enhanced by size reduction and ease of handling, wherein assembly at the site of use is in accordance with adhesive technology using cooperating adhesives which adhere only to each other so that these adhesives are also advantageously applied at the manufacturing site and do not detract from the facilitated shipment of the pallet components as might occur if inadvertent contact was made by these adhesives to surfaces other than each other.

1 Claim, 2 Drawing Sheets

METHOD OF MANUFACTURING A PALLET OF CARDBOARD

The present invention relates to improvements for a cardboard pallet, and more particularly to the construction improvements thereof which facilitate its embodiment at a site of manufacture preliminarily as a work-in-process component preparatory to shipment to a site of use where it is readily assembled into a completed article-of-manufacture, thereby contributing to significant savings in shipping, storage and handling expense.

EXAMPLE OF THE PRIOR ART

U.S. Pat. No. 5,176,090 for "Recyclable Paper Pallet" issued to Mark Roberts et al. on Jan. 5, 1993 describes and illustrates a paper pallet which can be shipped and stored as two die cut and scored cardboard pieces for which the benefit claimed is eliminating excess volume. Presumably this savings in volume occurs during shipment from a manufacturing site of the cardboard pieces to a site where the cardboard pieces, after assembly into a pallet, are used for supporting weight loads and in other typical ways. At the site of use, however, the assembly contemplates use of plural interconnecting tabs and slots, which is time consuming and tedious thereby contributing to a standoff of an added complication at the user's site offsetting the benefit gained at the manufacturing site.

Broadly, it is an object of the present invention to provide an unassembled pallet for the shipping benefit this provides, which is also readily assembled at the use site thereby overcoming the foregoing and other shortcomings of the prior art.

More particularly, the pallet components which, to eliminate "excess volume" are shipped in unassembled condition, are assembled adhesively rather than by mechanical interlocking, but with optimum minimum implementation of the adhesive function at the user's site. That is, the major preparation for the adhesive function at the user's site is attended to at the manufacturer's site, and yet the unassembled adhesively-prepared pallet components present no problem during separate shipment and are readily assembled preparatory to use as a completed pallet.

The aforesaid is achieved, as will be better understood as the description proceeds, using to advantage adhesive technology provided by cooperating adhesives which attach only to each other and not otherwise to surfaces as might inadvertently be contacted during separate shipment of the unassembled pallet components.

The description of the invention which follows, together with the accompanying drawings should not be construed as limiting the invention to the example shown and described, because those skilled in the art to which this invention appertains will be able to devise other forms thereof within the ambit of the appended claims.

Figure 5:
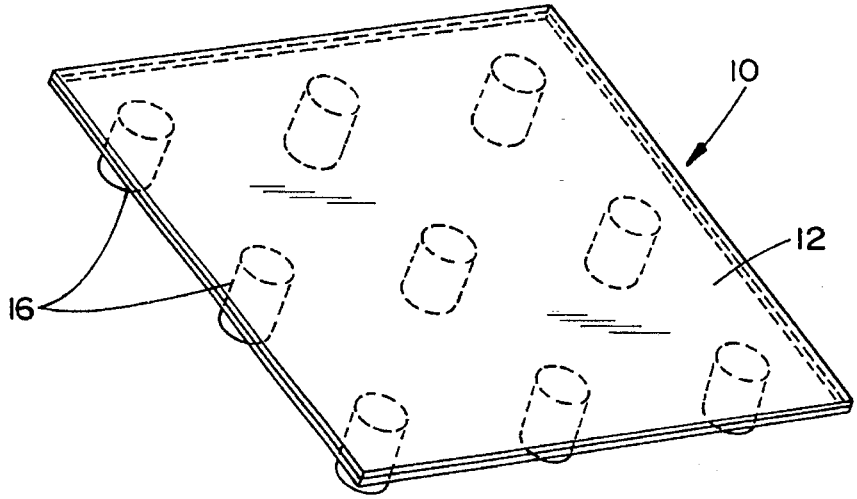
FIG. 5 is a perspective view of the pallet as a completed article-of-manufacture.
Figure 6:
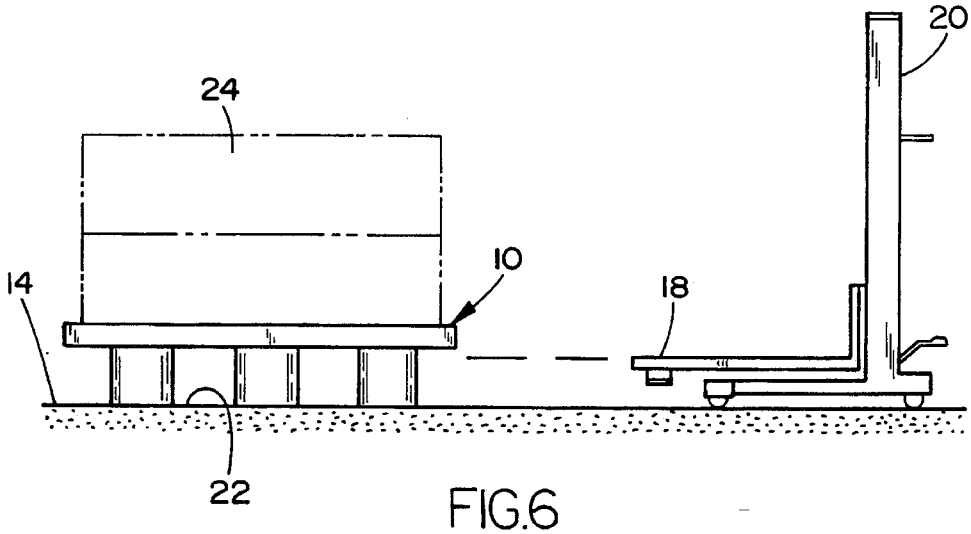
FIG. 6 is a side elevational view illustrating typical use of the pallet.
Figure 7A:
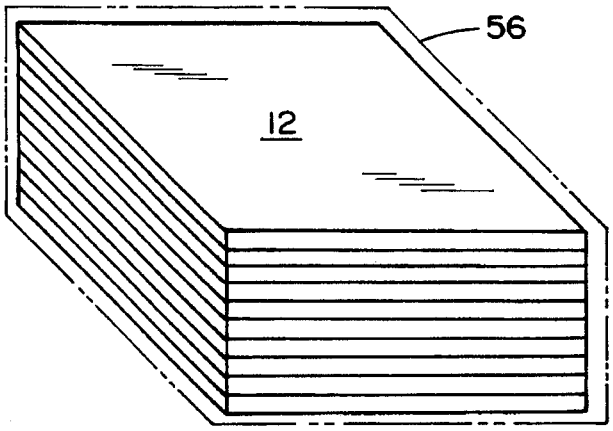
FIGS. 7A and 7B are perspective views illustrating the unassembled platform and leg components as prepared at a manufacturer's site for shipment to a site of use as depicted in FIG. 6.
Figure 7B:
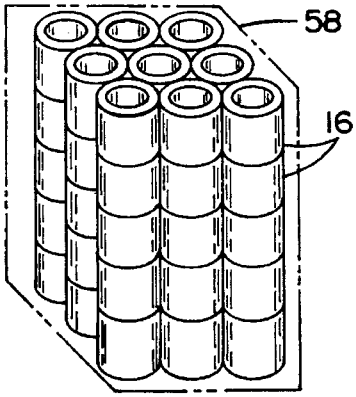

The within inventive pallet, as illustrated in FIG. 5 and denoted by the reference number 10, as a completed article-of-manufacture at a site of use has, for the weight-supporting purposes intended, a platform 12 supported in a clearance position above a factory floor 14 or the like (FIG. 6) on plural legs, individually and collectively designated 16, so that, as depicted in FIG. 6, tines 18 of a fork lift truck 20 can be projected in the clearance 22 beneath the platform to lift and transport weight loads 24 in position on the pallet 10.

Figure 1:
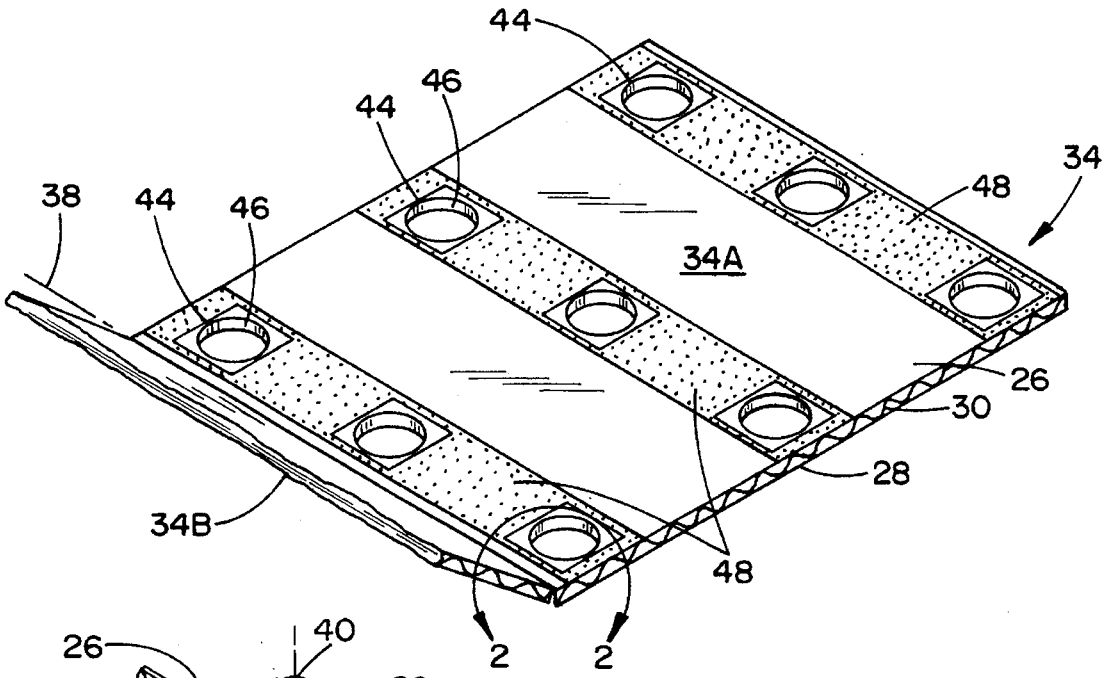
FIG. 1 is a partial perspective view of a work-in-process weight-supporting platform of a cardboard pallet according to the present invention.
Figure 2:
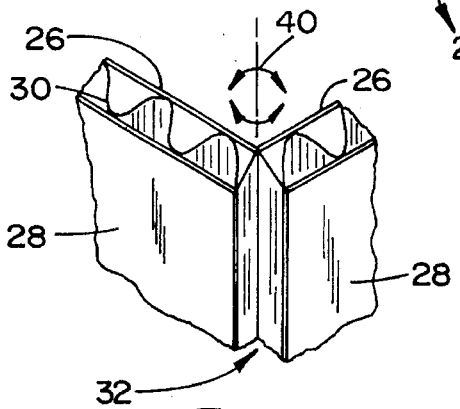
FIG. 2 is a detail perspective view on an enlarged scale and, as taken along lines 2—2 of FIG. 1, of a hinge of the pallet component of FIG. 1.

Some unique aspects of the pallet 10, among others, reside in the cardboard construction material of the pallet 10 consisting, as best shown in FIGS. 1 and 2, of opposite paper plies 26 and 28 adhesively secured to an intermediate undulating flute 30 and using this construction material to fullest advantage, the making of a hinge 32 by cutting in a medial location in a work-in-process blank 34 (FIG. 1) to a selected depth through the one paper ply 28, the undulated flute 30 and leaving intact the other paper ply 26 so that, as should be readily appreciated from FIGS. 1 and 2, the two halves designated 34A and 34B delineated by the medial cut 38 can be urged through pivotal traverses 40 about the uncut paper ply 26.

Figure 4:
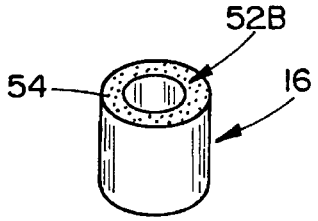
FIG. 4 is an isolated view of the leg component of the within inventive pallet.
Figure 3:
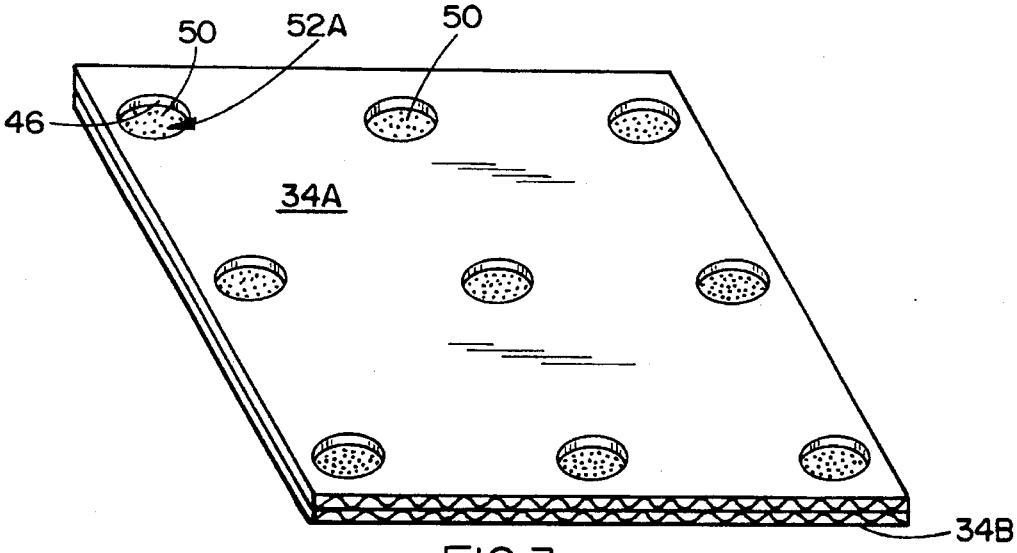
FIG. 3 is a perspective view of the pallet component of FIG. 1 at a subsequent condition of construction.

The blank 34, as removed at a manufacturer's site from a cardboard substrate is in a selected sized rectangular shape that is twice the size of the completed pallet 10 of FIG. 5, so that following a pivotal traverse about the hinge 32 the pallet half 34A is in superposed relation upon the pallet half 34B forming the work-in-process two ply assembly 42 of FIG. 3. However, prior to this assembly step, pallet half 34A is die-cut with three rows 44 each of openings 46 sized to have seated therein cardboard cores, as shown in isolated perspective in FIG. 4, which are cut to the length shown in FIG. 4 to effectively serve as the noted pallet legs 16. The cores which are cut to pallet leg length are the center supports of paper rolls which nominally are discarded. That is, as generally known, paper for commercial use is usually put up in a supply roll and the central support for such roll is typically a spiral wound core or spindle about which the paper, in an elongated strip, is helically wound. After the paper is unwound or used, the referred-to core is usually discarded.

Another preliminary preparation step consists of applying a first adhesive as a coating 48 in the three locations co-extensive with the rows 44 which adhesively secure the pallet halves 34A and 34B to each other to provide the work-in-process construction at the pallet manufacturer's site which is depicted in FIG. 3.

A final preparation step before shipment to a user's site consists of flipping the pallet assembly as initially formed, as shown in FIG. 1, 180 degrees so that surfaces 50 in the pallet half 34B are exposed through the other pallet half openings 46. To the surfaces 50 there is applied a coating 52A of a second adhesive selected to have a limited adhesive function, wherein coating 52A does not provide an adhesive function except upon contact with a cooperating coating 52B, one such second adhesive being used in practice with good results is commercially available from Impact Chemical Corp. of Patterson, N.J., identified as LTX4801.

In accordance with the present invention, coating 52B is applied to an end surface 54 of each leg 16 with the result that the applied adhesive coatings 52A and 52B do not adhere, by intention or inadvertently, to any contacting surface, but only provide an adhesive function when placed in contact with each other, as occurs when the pallet legs 16 are seated in the cooperating openings 46, an assembly step that is not practiced at the pallet manufacturer's site but only at the user's site. The important reason for this is that the within inventive method contemplates the shipment, in unassembled relation, of an appropriate selected number of work-in-process weight supporting platforms 12 in one shipping container 56, and in a separate shipping container 58 an appropriate selected number of as yet unattached plural pallet legs 16. As should be readily appreciated, the savings in space requirements using the containers 56 and 58 for the unassembled pallet components 12 and 16, as compared with shipping the same number of complete pallets 10 of FIG. 5, is significant and underlies the present invention. At the user's site, and as needed, the legs 16 are assembled to the platforms 12, merely upon establishing contact between the adhesive coatings 52A and 52B thereof, resulting in completed pallets 10 ready for typical FIG. 6 end use.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of manufacturing of cardboard construction material preliminarily a work-in-process at a manufacturer's site and subsequently a completed article-of-manufacture at a user's site a pallet of a type consisting of a weight-supporting platform having plural legs adhesively secured in depending relation therefrom to provide clearance beneath said weight-supporting platform for tines of a fork lift truck, said manufacturing method comprising the steps of removing from a cardboard substrate constructed of an undulating flute interposed between opposite surface plies a rectangular blank of a size selected to be twice the size of a weight-supporting platform of a pallet, cutting in a medial location transversely of said blank to a selected depth through one said surface ply and said undulating flute and leaving intact said other surface ply so as to allow the folding along said medial location of one half of said blank upon said other half of said blank, die-cutting in one said half blank at select locations nine openings of three rows of three openings for receiving therein cooperating leg supports for said pallet, applying a first adhesive along said three rows of three openings and folding said halves of said blank in superposed relation to each other for adhesive attachment thereof into a two ply construction to provide a work-in-process weight-supporting platform for said pallet, applying a two-part adhesive of a type chemically inert except in contacting relation to each other of which one said part is applied to a surface of said one half panel exposed through an opening of said other half panel and of which the other said part is applied to a peripheral edge of a cylindrical pallet leg support sized to be seated in a cooperating die-cut opening, and transporting in a compact condition a select number of work-in-process weight-supporting platforms and pallet leg supports in unassembled relation to each other from a manufacturer's site to a user's site, whereby each said work-in-process pallet platform and pallet leg supports are readily assembled into an article-of-manufacture pallet incident to contact of said two parts of said second adhesive thereon resulting in an embodiment having a full-sized condition for weight-supporting service.

* * * * *